US011560013B2

(12) United States Patent
Guilbert

(10) Patent No.: US 11,560,013 B2
(45) Date of Patent: Jan. 24, 2023

(54) CAP FOR A PENCIL

(71) Applicant: SOCIETE BIC, Clichy (FR)

(72) Inventor: Patrick Guilbert, margny-Compiegnes (FR)

(73) Assignee: SOCIÉTÉ BIC, Clichy (FR)

( * ) Notice: Subject to any disclaimer, the term of this patent is extended or adjusted under 35 U.S.C. 154(b) by 370 days.

(21) Appl. No.: 16/643,821

(22) PCT Filed: Sep. 4, 2018

(86) PCT No.: PCT/FR2018/052161

§ 371 (c)(1),
(2) Date: Apr. 6, 2020

(87) PCT Pub. No.: WO2019/048773

PCT Pub. Date: Mar. 14, 2019

(65) Prior Publication Data

US 2020/0376884 A1 Dec. 3, 2020

(30) Foreign Application Priority Data

Sep. 5, 2017 (FR) ..... 1758168

(51) Int. Cl.
*B43K 23/10* (2006.01)
*B43K 25/02* (2006.01)

(52) U.S. Cl.
CPC ..... *B43K 23/10* (2013.01); *B43K 25/02* (2013.01)

(58) Field of Classification Search
CPC ..... B43K 23/10; B43K 25/02
See application file for complete search history.

(56) References Cited

U.S. PATENT DOCUMENTS 5,897,266 A * 4/1999 Robert ..... B43K 29/02 401/52
2004/0154172 A1* 8/2004 Tatz ..... B43L 19/0068 30/457
2005/0053411 A1 3/2005 Maldonado et al.
2006/0029460 A1 2/2006 Russo
2007/0031176 A1* 2/2007 Gieux ..... B43K 23/10 401/50
2013/0223916 A1* 8/2013 Lira-Nunez ..... B43K 23/12 401/202
2020/0062022 A1* 2/2020 Nakata ..... B43K 23/02
2020/0230998 A1* 7/2020 Edekar ..... B43K 29/004

FOREIGN PATENT DOCUMENTS

CN 206446320 8/2017

OTHER PUBLICATIONS

Chinese Office Action in corresponding Chinese Application No. 201880055183.3, dated Sep. 14, 2021 (7 pages).
International Search Report and Written Opinion issued in related International Application No. PCT/FR2018/052161, dated Nov. 26, 2018 (7 pages).

* cited by examiner

*Primary Examiner* — J C Jacyna
(74) *Attorney, Agent, or Firm* — Bookoff McAndrews, PLLC

(57) ABSTRACT

A cap for a pencil, comprising an insertion opening, at least two internal retainer ribs which are distributed angularly and uniformly about a central axis of the cap. The at least two internal retainer ribs positioned close to the insertion opening and configured to cooperate with an unsharpened portion of the pencil, and a stop surface which is configured to cooperate with a sharpened end of the pencil.

20 Claims, 4 Drawing Sheets

CAP FOR A PENCIL

CROSS REFERENCE TO RELATED APPLICATION(S)

This application is a National Stage Application of International Application No. PCT/FR2018/052161, filed on Sep. 4, 2018, now published as WO2019/048773 and which claims priority to French Application No. FR1758168, filed on Sep. 5, 2017, the entire contents of which is incorporated herein by reference.

TECHNICAL FIELD

The present disclosure relates to a cap for a pencil.

PRIOR ART

Caps for writing instruments other than pencils are known.

However, the structure of the caps does not make it possible to protect the sharpened end of a pencil while taking account of the dimensional tolerances of pencils, in particular pencils obtained by material coextrusion.

Indeed, when the diameter of the pencil is in the bottom limit of the tolerances, the cap may not grip the pencil sufficiently and may detach therefrom in an undesired manner, and/or when the diameter of the pencil is in the top limit of the tolerances, it may be the case that the pencil cannot be introduced into the cap.

There is thus a need for a pencil cap that makes it possible to effectively protect the sharpened end of a pencil, while taking account of the manufacturing tolerances of the pencil.

SUMMARY

The present disclosure aims to overcome these disadvantages, at least in part.

For this purpose, the present disclosure relates to a cap for a pencil comprising an insertion opening that is designed for receiving an end of the pencil, at least two internal holding ribs that are distributed angularly in a uniform manner about a central axis of the cap, are arranged in the vicinity of the insertion opening, and are designed for cooperating with a non-sharpened portion of the pencil, and an arresting surface that is designed to cooperate with a sharpened end of the pencil.

The internal ribs, i.e. ribs borne by the internal surface of the cap, may allow for pointwise contact between the pencil and the cap when the cap cooperates with the pencil, i.e. when the pencil is inserted in the cap. The contact between the cap and the pencil is thus achieved by means of the internal ribs which cooperate with a non-sharpened portion of the pencil. It will be understood that, in a plane perpendicular to the axial direction, the contact between the cap and the pencil is not achieved by cooperation between a continuous line borne by the internal surface of the cap and a continuous line of an external surface of the pencil, but by local cooperation of the internal ribs with the external surface of the pencil.

The internal ribs thus may allow for greater deformation of the cap. It is possible to take account of manufacturing tolerances of the pencil, i.e. variations in the diameter of the pencil, while guaranteeing that, when the diameter of the pencil is in the bottom limit of the tolerances, the cap grips the pencil sufficiently and does not detach therefrom in an undesired manner, and that, when the diameter of the pencil is in the top limit of the tolerances, the pencil could be introduced into the cap.

As a result, a non-sharpened portion of the pencil cooperates with the internal ribs, such that the pencil is retained in the cap. The pencil is thus held in the cap. The non-sharpened portion of the pencil may be a non-sharpened end of the pencil or a non-sharpened part of the pencil that is adjacent to the sharpened end of the pencil.

By virtue of the arresting surface, when the sharpened end of the pencil is introduced into the cap, the sharpened part of the pencil is fixed against the arresting surface, and the lead of the pencil cannot be pushed into the base of the cap. The lead of the pencil is protected and does not break. As a result of the internal ribs that are distributed in a uniform manner about the central axis of the cap, one single arresting surface makes it possible to ensure that the sharpened part of the pencil is not damaged when it is inserted into the cap.

Thus, it is possible to protect the sharpened point of the pencil by inserting the sharpened end of the pencil into the cap, and it is possible to insert the cap onto the non-sharpened end of the pencil when the pencil is used, the cap being retained on the pencil by means of a non-sharpened portion of the pencil cooperating with the internal ribs in the two configurations.

In some embodiments, the cap comprises three internal ribs.

As a result, since the internal ribs are distributed angularly and in a uniform manner, the internal ribs are provided every 120° in the cap. The presence of three internal ribs makes it possible to center the pencil in the cap, while limiting the number of internal ribs.

In some embodiments, the cap comprises a stop that is designed to cooperate with a non-sharpened end of the pencil.

The stop makes it possible to limit the insertion of the pencil into the cap, and thus the forces for insertion of the pencil into the cap and the separation of the pencil from the cap. The stop also makes it possible to limit the length, in the axial direction, of the part of the cap that is deformed when the pencil is inserted into the cap. The stop thus makes it possible to limit the insertion of the non-sharpened end of the pencil into the cap.

In some embodiments, the cap comprises a clip.

It is thus possible to reversibly attach the pencil, using the clip, to a pad of paper, to a shirt pocket, or to any other support that could be inserted between the clip and the cap.

In some embodiments, the cap comprises an eraser that is received in an eraser reception recess.

It is thus possible, when it is desirable to have an eraser on the pencil, not to have to set the eraser onto the pencil. Furthermore, it is possible to replace the eraser when it is worn, which is not possible when the eraser is set on the non-sharpened end of the pencil, for example, by means of a metal ring, or when the eraser is retained by means of clamping of a plastics ring soldered to the pencil or to the non-sharpened end of the pencil.

In some embodiments, at least one of the internal ribs comprises a guide surface that is designed for guiding the non-sharpened portion of the pencil during insertion thereof into the cap, the guide surface being at an angle of 10°+/−0.5° relative to the central axis, in a plane passing through the internal rib and the central axis of the cap.

The guide surface makes it possible to center the pencil in the cap, and to facilitate the insertion of the pencil into the cap.

In some embodiments, each internal rib comprises a guide surface.

In some embodiments, each internal rib comprises a clamping part that is designed to cooperate with the non-sharpened portion of the pencil, the clamping part having, in a plane perpendicular to the axial direction, an inscribed diameter of more than or equal to 95% of the minimum inscribed diameter of the pencil with which the cap is designed to cooperate, and less than or equal to 99% of the minimum inscribed diameter of the pencil with which the cap is designed to cooperate.

Inscribed diameter is intended to mean the diameter of the inscribed circle with respect to the internal ribs, in a plane perpendicular to the axial direction. Since the internal ribs are distributed angularly, in a uniform manner, it is possible to determine the diameter of a circle inscribed on the internal ribs, in a plane perpendicular to the axial direction. In the plane perpendicular to the axial direction, the internal ribs are arranged in accordance with the radii of the circle inscribed on the internal ribs.

The inscribed diameter of the clamping part is thus smaller than the inscribed diameter of the pencil, such that a non-sharpened portion of the pencil is retained in the cap by clamping of the internal ribs, in particular of the clamping part of the internal ribs, on the pencil. However, the inscribed diameter of the clamping part is such that the cap may deform when the pencil is inserted in the cap, as well as while the pencil is held in the cap.

For example, when the pencil has a hexagonal cross section, the diameter of the inscribed circle is the distance separating the two parallel faces of the pencil. When the pencil has a circular cross section, the inscribed diameter is the diameter of the circle.

In some embodiments, the clamping part of the internal rib is triangular in a plane perpendicular to the axial direction, an edge of the triangle being designed so as to be in contact with the pencil when the pencil is inserted into the cap.

It will be understood that the triangle may have a rounded edge, the contact between the pencil and the cap being achieved along the rounded edge.

In some embodiments, the inscribed diameter of the clamping part is designed such that the force in the axial direction, for separating the cap from the pencil, is greater than 3 N, specifically greater than 4 N, and less than 50 N, specifically less than 40 N.

For values below 3 N, there is a risk of the pencil separating from the cap when this is not desirable. For values above 50 N, the force for inserting the pencil into the cap becomes too great. These value ranges take account of manufacturing tolerances of the pencil, i.e. the possible variation in the diameter of the pencil.

In some embodiments, the stop and the arresting surface are borne by an arresting rib.

In some embodiments, the arresting rib is arranged in the extension of at least one of the internal ribs.

In some embodiments, the cap comprises an equal number of internal ribs and arresting ribs.

In some embodiments, each arresting rib is arranged in the extension of one internal rib.

In some embodiments, the arresting surface is at an angle of 9°+/−0.5° with respect to the central axis, and is arranged along a line of equation $y=0.1584\ x-0.6283$, in a plane passing through the central axis of the cap and cutting the arresting surface.

The arresting surface makes it possible to arrest the sharpened end of the pencil, such that the sharpened end of the pencil, i.e. the lead of the pencil, is not damaged, and that the lead of the pencil is protected when being inserted into the cap.

The gradient of the arresting surface makes it possible to take account of the different pavilion angles used. Indeed, in the USA, the pavilion angle is 9° with respect to the central axis, whereas in Europe the pavilion angle is 15° with respect to the central axis. Since the angle of the arresting surface is 9°, this makes it possible to ensure that the sharpened end of the pencil is arrested in the cap, without damaging the sharpened end of the pencil, i.e. the lead of the pencil.

In the linear equation, the coordinate point $x=0$ is a point arranged on the interior surface of the base of the cap, i.e. the end that is opposite the insertion opening of the cap, in the axial direction, and a coordinate point $y=0$ is a point arranged on the central axis of the cap, the central axis being arranged so as to be in parallel with the axial direction.

In some embodiments, in a plane passing through the central axis of the cap and cutting the arresting surface, the arresting surface is arranged such that a minimum distance measured in the axial direction between any point of the arresting surface and the base of the cap is greater than or equal to 5 mm, specifically greater than or equal to 10 mm, or more specifically greater than or equal to 15 mm.

It will therefore be understood that the coordinate x represents the end of the arresting surface.

In some embodiments, the arresting rib is rectangular in shape, in a plane perpendicular to the central axis.

In some embodiments, the cap is hexagonal in shape, in a plane perpendicular to the central axis.

The hexagonal shape of the cap makes it possible to insert pencils of a circular or hexagonal cross section into the cap.

In some embodiments, the cap is hexagonal in shape, in a plane perpendicular to the central axis, and comprises three internal ribs.

The internal surface of the cap has alternating faces bearing an internal rib and faces without a rib. The internal ribs are arranged in the center of the internal face, in a plane perpendicular to the axial direction, i.e. in a plane perpendicular to the central axis.

In some embodiments, the cap is made of a polyolefin, for example polypropylene or polyethylene.

The materials have good deformation capacity.

BRIEF DESCRIPTION OF THE DRAWINGS

Other features of the disclosure will become clear from the following description of embodiments, given by way of non-limiting example and with reference to the accompanying drawings, in which.

DETAILED DESCRIPTION

Figure 1:
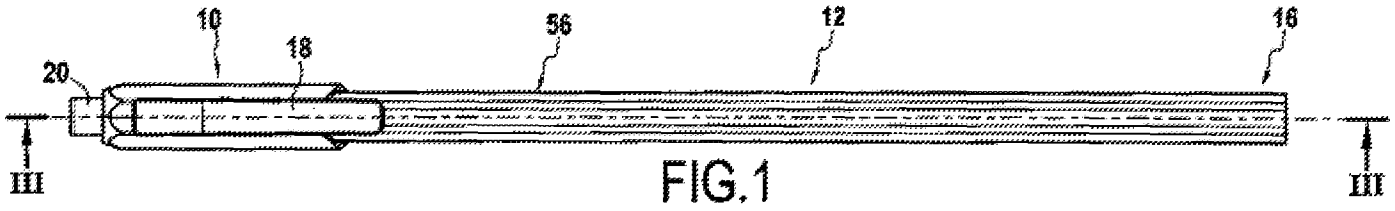
FIGS. 1 and 2 are side views of a cap fitted onto a pencil.
Figure 2:
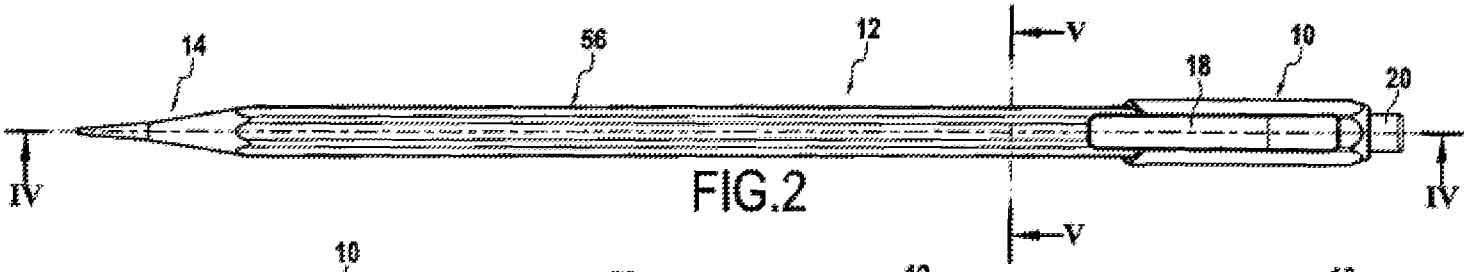
Figure 3:
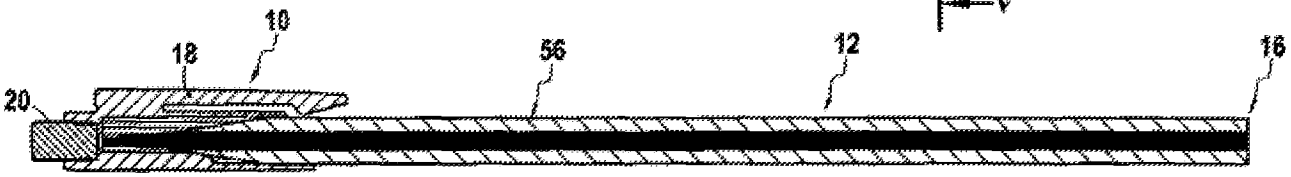
FIGS. 3, 4 and 5 are cross-sectional views of FIGS. 1 and 2, according to the sectional planes IV-IV, and V-V, respectively.
Figure 4:
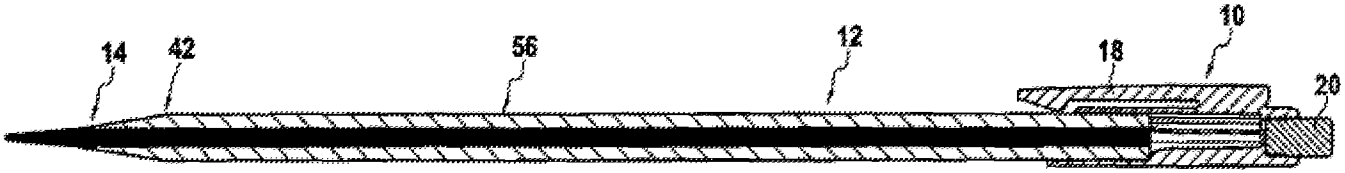
Figure 5:
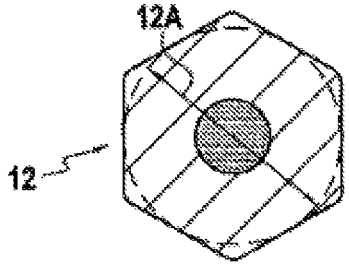

FIGS. 1 and 2 show a cap 10 that is immovably mounted on a pencil 12. In FIG. 1, the cap 10 is mounted on a sharpened end 14 of the pencil 12, i.e. the sharpened end 14 of the pencil 12 is inserted into the cap 10, as shown in FIG. 3. In FIG. 2, the cap 10 is mounted on a non-sharpened end 16 of the pencil 12, i.e. the non-sharpened end 16 of the pencil 12 is inserted into the cap 10, as shown in FIG. 4.

The cap 10 comprises a clip 18 and an eraser 20 that is received in an eraser reception recess 22. The eraser reception recess 22 is visible in particular in FIG. 6A.

Figure 6A:
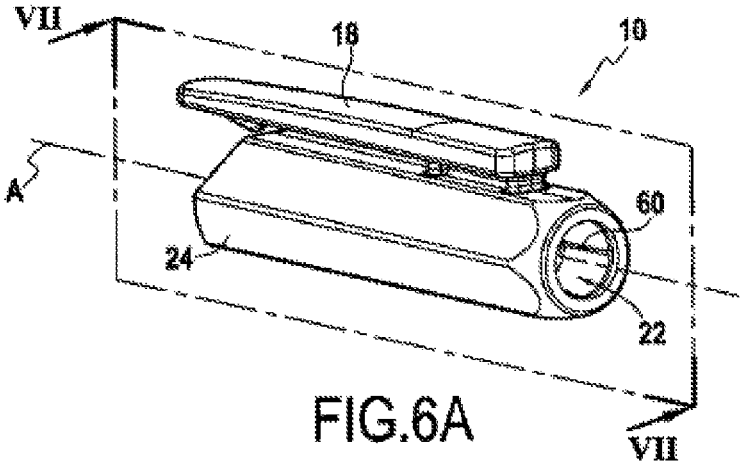
FIGS. 6A and 6B are perspective views of the cap.
Figure 6B:
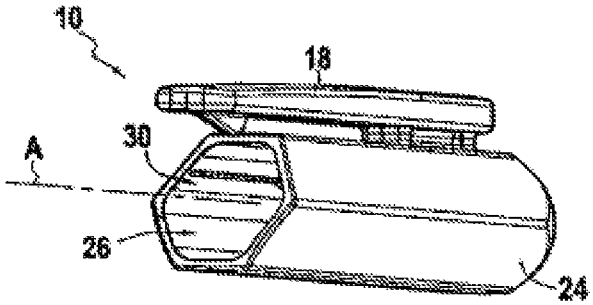

With reference to FIGS. 6A and 6B, the cap 10 has a central axis A that defines an axial direction of the cap 10. The cap 10 comprises a cap body 24 to which the clip 18 is attached and in which the eraser reception recess 22 is arranged. The eraser reception recess 22 comprises ribs 60 that make it possible to retain the eraser 20 in the eraser reception recess 22 by means of radial clamping of the eraser 20 by the ribs 60.

In the embodiment in the figures, the cap body 24 has a generally hexagonal cross-sectional shape in a sectional plane perpendicular to the central axis A, i.e. in a sectional plane perpendicular to the axial direction of the cap.

The cap 10, and more particularly the cap body 24, comprises an insertion opening 26 that is designed for receiving the ends 14, 16 of the pencil 12.

The cap 10, and more particularly the cap body 24, comprises an internal surface 28 that bears at least two internal ribs 30 that are angularly distributed in a uniform manner about the central axis A of the cap 10 and extend in the axial direction, i.e. in parallel with the central axis A.

In the embodiment in the figures, the cap 10 comprises three internal ribs 30 that are angularly distributed in a uniform manner about the central axis A of the cap 10. The internal ribs 30 are distributed every 120°, as shown in particular in FIG. 9. The internal surface 28 of the cap 10 thus has alternating faces 32 bearing an internal rib 30 and faces 32 without a rib. Viewed in cross section, in a plane perpendicular to the central axis A, the internal ribs 30 are arranged in the center of the face 32.

In the embodiment in the drawings, the cap 10 comprises an equal number of internal ribs 30 and arresting ribs 36, each arresting rib 36 being arranged in the extension of an internal rib 30. However, the number of arresting ribs 36 may be different from the number of internal ribs 30. It is possible that the arresting ribs 36 may not be distributed in a uniform manner about the central axis A of the cap 10. It is also possible that the arresting ribs 36 may not be arranged in the extension of an internal rib 30.

Figure 7:
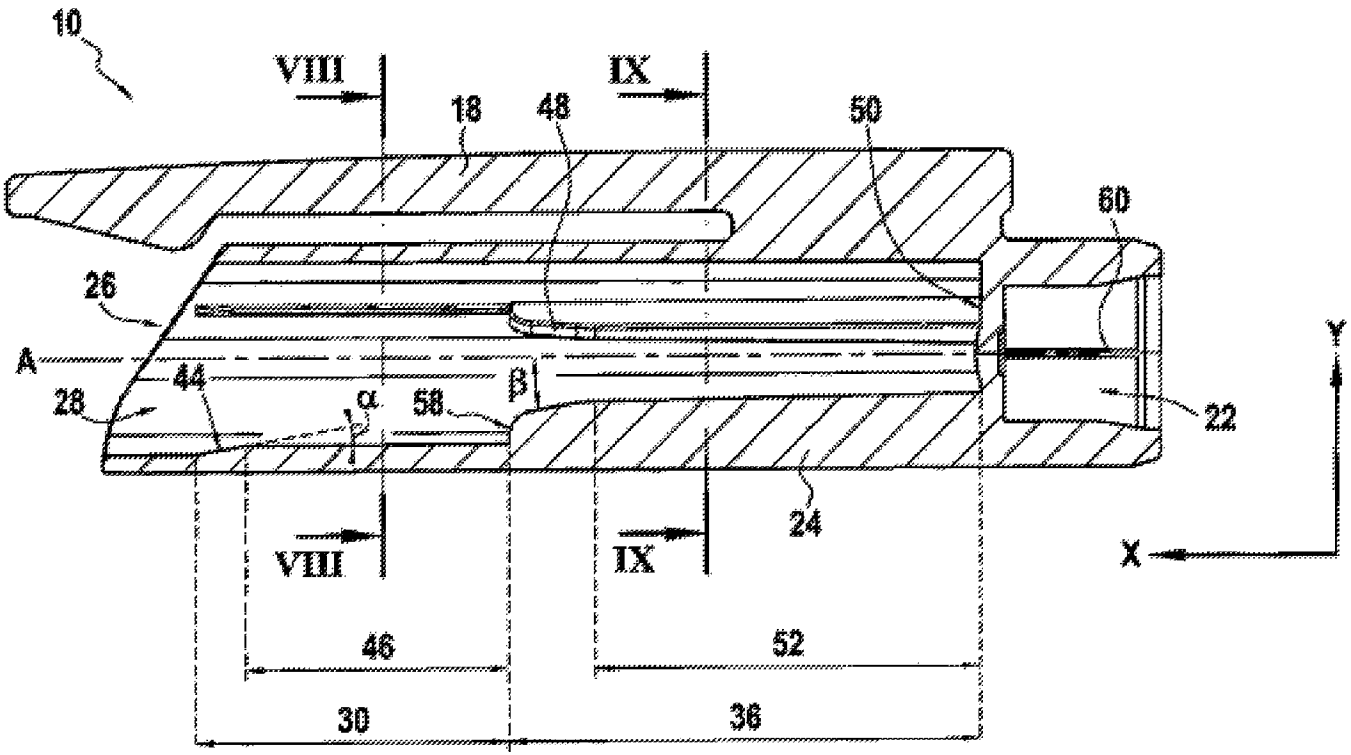
FIG. 7 is a schematic cross-sectional view of the cap according to the sectional plane VII-VII of FIG. 6A.

As shown in FIG. 7, each internal rib 30 is arranged in the vicinity of the insertion opening 26, and one arresting rib 36 is arranged in the extension of each internal rib 30, so as to be opposite the insertion opening 26 with respect to the internal rib 30. In a plane perpendicular to the axial direction A, each internal rib 30 and each arresting rib 36 has an inscribed diameter. The inscribed diameter 38 of the internal rib 30 is greater than the inscribed diameter 40 of the arresting rib 36, as shown in FIG. 8.

As shown in FIGS. 3 and 4, the internal rib 30 cooperates with a non-sharpened portion of the pencil 12, or with the non-sharpened end 16 of the pencil when the non-sharpened end 16 of the pencil is inserted into the cap 10, or with a non-sharpened portion 42 of the pencil 12 that is adjacent to the sharpened end 14 of the pencil 12 when the sharpened end 14 of the pencil 12 is inserted in the cap 10. It will therefore be understood that, when the pencil 12 is not inserted into the cap 10, the internal rib 30 is designed so as to cooperate with a non-sharpened portion of the pencil 12, or the non-sharpened end 16 of the pencil 12, or the non-sharpened part 42 of the pencil 12 that is adjacent to the sharpened end 14 of the pencil 12.

The internal rib 30 comprises a guide surface 44 for guiding the non-sharpened portion of the pencil 12 during insertion of the pencil 12 into the cap 10, and a clamping part 46 that is designed to cooperate with the non-sharpened portion of the pencil 12. In a plane passing through the internal rib 30 and the central axis A of the cap 10, the guide surface 44 is at an angle $\alpha$ of 10°+/−0.5° relative to the central axis A.

Figure 8:
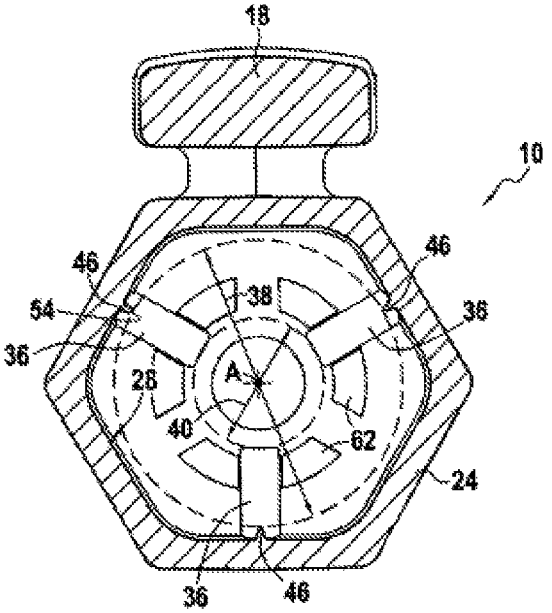
FIG. 8 is a schematic cross-sectional view of the cap according to the sectional plane VIII-VIII of FIG. 7.
Figure 9:
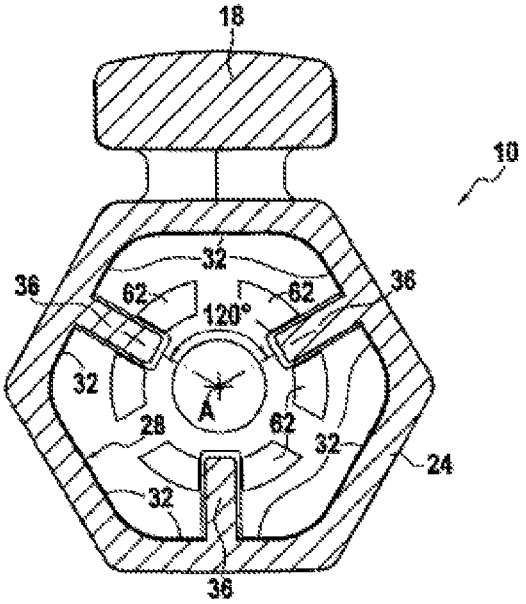
FIG. 9 is a schematic cross-sectional view of the cap according to the sectional plane IX-IX of FIG. 7.

As shown in FIGS. 8 and 9, the clamping part 46 of the internal rib 30 is triangular in a plane perpendicular to the axial direction, i.e. in a plane perpendicular to the central axis A, an edge 54 of the triangle being designed so as to be in contact with the pencil 12 when the pencil 12 is inserted into the cap 10. The edge 54 of the triangle may be rounded, and the contact between the pencil 12 and the cap 10 is achieved along the rounded edge 54, between the edge 54 and an external surface of the pencil 12.

The internal ribs 30, and more particularly the clamping part 46 of each internal rib 30, makes it possible to hold the non-sharpened portion of the pencil 12, by means of radial clamping between the clamping parts 46 of the non-sharpened portion of the pencil 12, when the pencil 12 is inserted into the cap 10.

For example, the inscribed diameter 38 of the clamping part 46 of the cap 10 is more than or equal to 95% of the minimum inscribed diameter of the pencil 12, with which the cap 10 is designed to cooperate, and the inscribed diameter 38 of the clamping part 46 of the cap 10 is less than or equal to 99% of the minimum inscribed diameter of the pencil 12, with which the cap 10 is designed to cooperate.

It is also possible to determine the inscribed diameter of the internal ribs 30 on the basis of the force to be exerted in the axial direction, in order to separate the cap 10 from the pencil 12. For example, the force to be exerted in the axial direction, for separating the cap 10 from the pencil 12, may be greater than 3 N, specifically greater than 4 N, and may be less than 50 N, specifically less than 40 N.

The arresting rib 36 is designed so as to cooperate with the sharpened end 14 of the pencil 12 when the sharpened end 14 of the pencil 12 is inserted into the cap 10, and to cooperate with non-sharpened 16 of the pencil 12 when the sharpened end 16 of the pencil 12 is inserted in the cap 10.

In particular, the arresting rib 36 comprises an arresting surface 48 that is designed to cooperate with the sharpened end 14 of the pencil 12. The arresting surface 48 is at an angle of 9°+/−0.5° with respect to the central axis A, and is arranged along a line of equation $y=0.1584\ x-0.6283$, in a plane passing through the central axis A of the cap 10 and cutting the arresting surface 48. In the linear equation, the coordinate point $x=0$ is a point arranged on the internal surface 28 of a base 50 of the cap 10, i.e. the end that is opposite the insertion opening 26 of the cap 10, in the axial direction, and a coordinate point $y=0$ is a point arranged on the central axis A of the cap 10, the central axis A being arranged so as to be in parallel with the axial direction.

In FIG. 7, a minimum distance 52 measured in the axial direction, between any point on the arresting surface 48, and the base 50 of the cap 10, is for example greater than or equal to 15 mm. Along the minimum distance 52, the arresting rib 36 has a gradient that forms an angle with the central axis A that is smaller than the angle $\beta$.

The arresting rib 36 comprises a stop 58 that is designed to cooperate with the non-sharpened end 16 of the pencil 12.

The stop 58 is a surface of the arresting rib 36 which is perpendicular to the central axis A, i.e. perpendicular to the axial direction.

In the embodiment in the figures, each arresting rib 36 comprises a stop 58. However, the stop function may be obtained in a satisfactory manner by means of a stop 58 that is provided on just one of the arresting ribs 36, or at least in a design where some of the arresting ribs 36 do not comprise a stop. The stop 58 is arranged between the insertion opening 26 and the arresting surface 48.

It is possible that the cap 10 may not comprise a stop 58. For example, the arresting surface 48 may extend towards the insertion opening 26, and the non-sharpened end 16 of the pencil 12 may come into abutment against the arresting surface 48 when the non-sharpened end 16 of the pencil 12 is inserted into the cap 10.

As shown in FIGS. 8 and 9, the arresting rib 36 is rectangular in a plane perpendicular to the axial direction, i.e. in a plane perpendicular to the central axis A.

As shown in FIGS. 8 and 9, the base 50 of the cap 10 comprises a plurality of through-openings 62.

When the non-sharpened end 16 of the pencil 12 is inserted into the cap 10, the non-sharpened end 16 of the pencil 12 is guided and centered in the cap 10 by means of the guide surface 44. When the non-sharpened portion of the pencil 12, in the present case the non-sharpened end 16 of the pencil 12, reaches the clamping part 46 of the internal rib 30, the non-sharpened end 16 of the pencil 12 is held by means of radial clamping, exerted by means of cooperation of the clamping part 46 of each internal rib 30 on the external surface 56 of the pencil 12. The pencil 12 is inserted until the non-sharpened end 16 of the pencil 12 comes into abutment against the stops 58 of each arresting rib 36. The cap 10 is immovably mounted on the pencil 12. The sharpened end 14 of the pencil 12 could be used for writing.

When the sharpened end 14 of the pencil 12 is inserted into the cap 10, the non-sharpened part 42 of the pencil 12 that is adjacent to the sharpened end 14 of the pencil 12 is guided and centered in the cap 10 by means of the guide surface 44. When the non-sharpened portion of the pencil 12, in the present case the non-sharpened part 42 of the pencil 12 that is adjacent to the sharpened end 14 of the pencil 12, reaches the clamping part 46 of the internal rib 30, the non-sharpened part 42 of the pencil 12 is held by means of radial clamping, exerted by means of cooperation of the clamping part 46 of each internal rib 30 on the external surface 56 of the pencil 12. The pencil 12 is inserted until the sharpened end 14 comes into abutment against the arresting surface 48 of each arresting rib. The cap 10 is immovably mounted on the pencil 12, and the sharpened end 14 of the pencil 12 is inserted into the cap 10, such that the sharpened end 14 of the pencil 12 is protected by the cap 10.

For example, a hexagonal pencil 12 may be obtained by coextrusion of the pencil 12. The pencil 12 typically has an inscribed diameter 12A of 6.7 mm. In practice, the inscribed diameter of the pencil 12 may vary between 6.7 mm and 7 mm.

The inscribed diameter 38 of the clamping part 46 of the internal ribs 30 will therefore be between 6.37 mm and 6.63 mm.

The internal surface 28 of the cap 10 may be at an angle of between 0.25°+/−0.1° with respect to the central axis A, in order to facilitate demolding of the cap 10 during the manufacture thereof.

Although the present disclosure has been described with reference to a specific embodiment, it is clear that various amendments and changes could be made to these embodiments without departing from the general scope as defined by the claims. Furthermore, individual features of the various embodiments mentioned may be combined in additional embodiments. Therefore, the description and the drawings should be considered to be illustrative rather than restrictive.

For example, the cap 10 may be of a generally cylindrical shape. However, if there is a desire for a cylindrical cap to be able to be mounted on a hexagonal pencil, a rib height may be provided that is sufficiently large that the angles formed by two successive faces of the hexagon may be received in the cap.

The invention claimed is:

1. A cap for a pencil comprising an insertion opening that is designed for receiving an end of the pencil, at least two internal holding ribs that are distributed angularly in a uniform manner about a central axis of the cap, the at least two internal holding ribs being arranged in the vicinity of the insertion opening and being designed for cooperating with a non-sharpened portion of the pencil, an arresting surface that is designed to cooperate with a sharpened end of the pencil, and a stop that is designed to cooperate with a non-sharpened end of the pencil, wherein the stop and the arresting surface are borne by an arresting rib, and wherein the arresting surface is configured to cooperate with the sharpened part of the pencil such that the lead of the pencil cannot be pushed into a base of the cap.

2. A cap according to claim 1, comprising a clip.

3. A cap according to claim 1, comprising an eraser that is received in an eraser reception recess.

4. A cap according to claim 1, wherein at least one of the internal ribs comprises a guide surface that is designed for guiding the non-sharpened portion of the pencil during insertion thereof into the cap, the guide surface being at an angle ($\alpha$) of 10°+/−0.5° relative to the central axis, in a plane passing through the internal rib and the central axis of the cap.

5. A cap according to claim 1, wherein each internal rib comprises a clamping part that is designed to cooperate with the non-sharpened portion of the pencil, the clamping part having, in a plane perpendicular to the axial direction, an inscribed diameter of more than or equal to 95% of the minimum inscribed diameter of the pencil with which the cap is designed to cooperate, and less than or equal to 99% of the minimum inscribed diameter of the pencil with which the cap is designed to cooperate.

6. A cap according to claim 5, wherein the clamping part of the internal rib is triangular in a plane perpendicular to the axial direction, an edge of the triangle being designed so as to be in contact with the pencil when the pencil is inserted into the cap.

7. A cap according to claim 5, wherein the inscribed diameter of the clamping part is designed such that the force in the axial direction, for separating the cap from the pencil, is greater than 3 N and less than 50 N.

8. A cap according to claim 1, wherein the arresting rib is arranged in the extension of at least one of the internal ribs.

9. A cap according to claim 1, wherein the arresting surface is at an angle ($\beta$) of 9°+/−0.5° with respect to the central axis, and is arranged along a line of equation $y=0.1584\ x-0.6283$, in a plane passing through the central axis of the cap and cutting the arresting surface, a coordinate point $x=0$ being the point that is arranged on the interior surface of the base of the cap at an opposite end in an axial direction to the insertion opening of the cap, and a coordinate point $y=0$ being the point that is arranged on the central axis of the cap.

10. A cap according to claim 1, wherein the cap is hexagonal in shape, in a plane perpendicular to the central axis, and comprises three internal ribs.

11. A pencil cap comprising: an opening for receiving an end of a pencil, a pair of ribs positioned angularly and uniformly about a central axis of the pencil cap, the pair of ribs being positioned adjacent to the opening and configured to cooperate with a non-sharp portion of the pencil, a surface configured to cooperate with a sharp end of the pencil, and a stop configured to cooperate with the non-sharp end of the pencil, wherein the stop and the surface are borne by an arresting rib, wherein each rib of the pair of ribs comprises a clamp configured to cooperate with the non-sharp portion of the pencil, the clamp having a fixed, inscribed diameter positioned in a plane perpendicular to an axial direction, and wherein the fixed, inscribed diameter is equal to or greater than about 95% of a minimum inscribed diameter of the pencil and less than or equal to about 99% of the minimum inscribed diameter of the pencil.

12. The pencil cap according to claim 11, wherein the clamp of each rib is triangular in a plane perpendicular to the axial direction, wherein an edge of the triangle contacts the pencil when received into the pencil cap.

13. The pencil cap according to claim 11, wherein the inscribed diameter of the clamp is configured such that a force in the axial direction for separating the pencil cap from the pencil is greater than 4 N and less than 40 N.

14. The pencil cap according to claim 11, wherein the pencil cap comprises three ribs and includes a hexagonal shape in a plane perpendicular to the central axis.

15. A cap for a pencil comprising a cap body and an opening sized to receive an end of the pencil, three internal ribs, uniformly distributed about a central axis of the cap, the three internal ribs located proximate to the opening and cooperating with a non-sharpened portion of the pencil, an arresting surface that is fixed with respect to the cap body, the arresting surface cooperating with a sharpened end of the pencil, and a stop cooperating with a non-sharpened end of the pencil, wherein the stop and the arresting surface are borne by at least a third rib of the three internal ribs, wherein the cap has a hexagonal shape in a perpendicular plane relative to the central axis.

16. A cap according to claim 15, wherein each of the internal ribs includes a triangular clamp in a plane perpendicular to an axial direction, an edge of the triangular clamp is in contact with the pencil when the pencil is inserted into the cap.

17. A cap according to claim 16, wherein the inscribed diameter of the triangular clamp is designed such that the force in the axial direction, for separating the cap from the pencil, is greater than 3 N and less than 50 N.

18. A cap according to claim 15, wherein each internal rib comprises a clamp designed to cooperate with the non-sharpened portion of the pencil, the clamp having, in a plane perpendicular to the axial direction, an inscribed diameter of more than or equal to 95% of the minimum inscribed diameter of the pencil with which the cap is designed to cooperate, and less than or equal to 99% of the minimum inscribed diameter of the pencil with which the cap is designed to cooperate.

19. A cap according to claim 1, wherein the inscribed diameter of the clamping part is designed such that the force in the axial direction, for separating the cap from the pencil, is greater than 4 N and less than 40 N.

20. The cap according to claim 15, wherein the arresting surface is configured to cooperate with the sharpened end of the pencil such that the lead of the pencil cannot be pushed into a base of the cap.

* * * * *